US005996383A

United States Patent [19]

Adelmeyer et al.

[11] Patent Number: 5,996,383

[45] **Date of Patent: *Dec. 7, 1999**

[54] LOCKSET WITH MOTION DETECTION AND AMBIENT LIGHT SENSORS

[75] Inventors: Gerard G. Adelmeyer, Anaheim; Joseph J. Fata, Moreno Valley; Charles E. Babb, Long Beach, all of Calif.

[73] Assignee: Emhart, Inc., Newark, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 08/693,830

[22] Filed: Jul. 31, 1996

[51] Int. Cl.[6] ..... E05B 15/08

[52] U.S. Cl. ..... 70/454; 70/DIG. 59; 70/DIG. 51; 70/441; 362/100

[58] Field of Search ..... 70/454, DIG. 59, 70/DIG. 51, 431, 432, 441; 362/100, 80; 315/200 A

[56] References Cited

U.S. PATENT DOCUMENTS

| | | | |
|---|---|---|---|
| 3,560,950 | 2/1971 | Peters | 340/567 |
| 4,234,909 | 11/1980 | Cotroneo | 362/100 |
| 4,305,021 | 12/1981 | Schreiden | 315/159 |
| 4,777,570 | 10/1988 | Littles | 362/100 |
| 4,804,945 | 2/1989 | Millet | 340/567 |
| 4,890,093 | 12/1989 | Allison et al. | 340/567 |
| 5,015,994 | 5/1991 | Hoberman et al. | 340/567 |
| 5,057,975 | 10/1991 | Evigan | 362/100 |
| 5,179,325 | 1/1993 | Aragon, Jr. | 362/100 |
| 5,313,188 | 5/1994 | Choi et al. | 340/331 |
| 5,317,889 | 6/1994 | Solovieff et al. | 70/224 |
| 5,442,177 | 8/1995 | Boulos et al. | 340/567 |

*Primary Examiner*—Darnell M. Boucher
*Attorney, Agent, or Firm*—Harness, Dickey & Pierce, P.L.C.

[57] ABSTRACT

An electronic module which is located between the plug cover and the front flange of the cylinder body has light and motion sensors that look out through holes in the cover. Whenever it is dark and a person approaches the lockset a light will be turned on to illuminate a translucent ring that surrounds the keyway.

13 Claims, 5 Drawing Sheets

LOCKSET WITH MOTION DETECTION AND AMBIENT LIGHT SENSORS

The present invention relates to locksets and more particularly to exterior locksets wherein the keyhole area can be illuminated to facilitate entrance.

It is an object of the present invention to provide a keyhole area light in a lockset which senses that a person is approaching the door and illuminates the keyhole light.

Other objects and advantages of the present invention will become apparent from the following portion of the specification and from the attached drawings which disclose, in accordance with the mandate of the patent statutes, a presently preferred embodiment of the invention.

Referring to the drawings.

Figure 1:
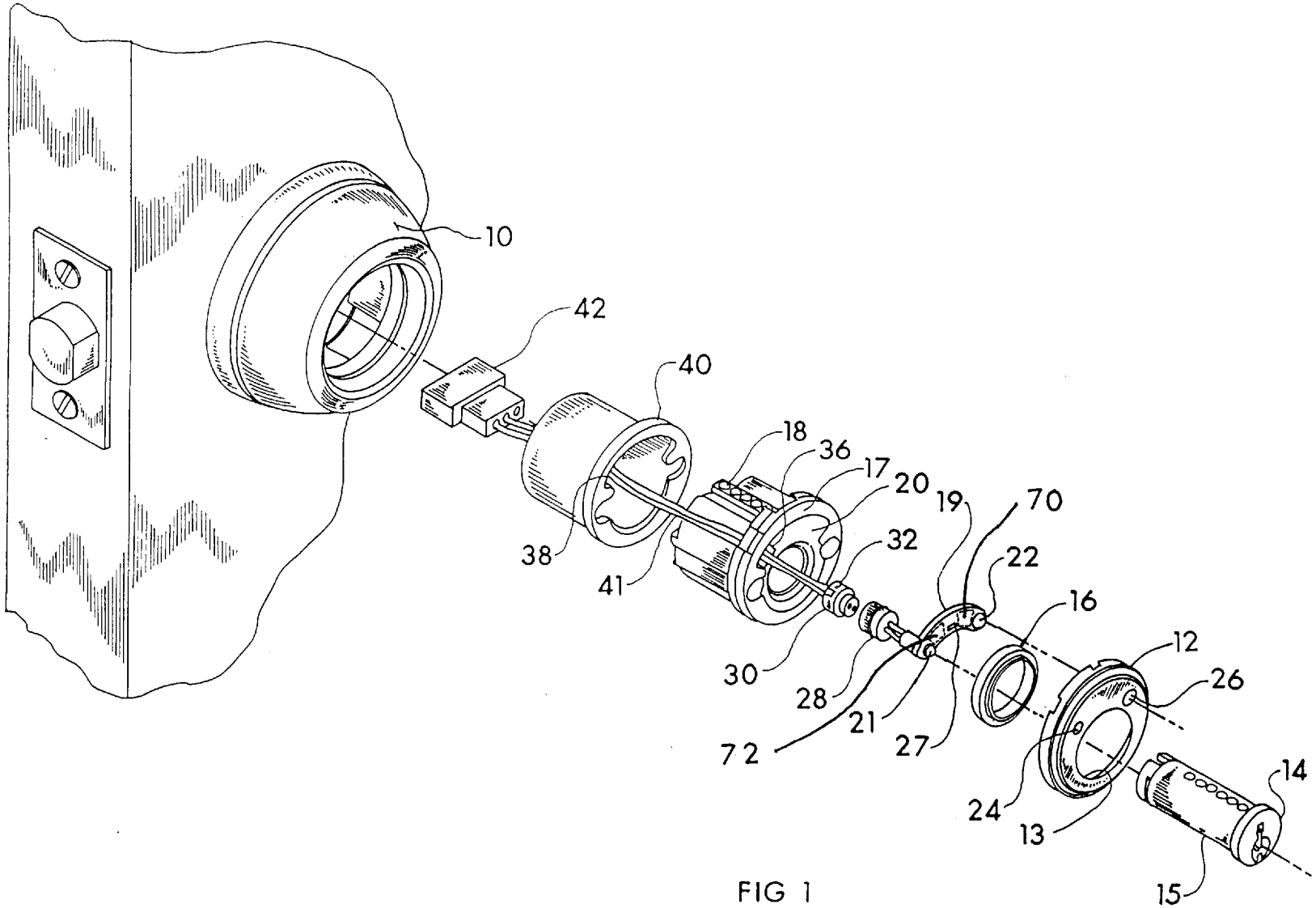
FIG. 1 is an oblique separated view of the exterior deadbolt portion of a handleset.

The upper deadbolt which is shown in FIG. 1, includes a cylinder guard cover 10 which is closed by a cylinder cover 12. The opening 13 in the cylinder cover 12 receives the face 14 of the cylinder plug 15 and an annular serrated translucent ring 16 which extends around the plug face. Positioned between the cylinder cover and the front flange 17 of the cylinder body 18 is an electronic module 19 (the electronic module is received within a recess 20 defined in the front flange of the plug body 17) which has an integrated photocell light sensor 21 for detecting ambient light and an integrated motion detection sensor 22, which detect the environment through two holes 24, 26 in the cylinder cover and an integrated light emitting diode (L.E.D.) 27. The ring L.E.D., when activated, emits light radially from the electronic module which has a curved inner surface that mates with the outer annular surface of the serrated translucent ring so that light emitted from the serrated translucent ring will illuminate the keyhole area (the serrated translucent ring projects slightly outwardly from the cylinder cover to increase the amount of light directed to the keyhole area). The electronic module is connected to the power source by means of a 3-circuit flexible circuit 30 routed through the cylinder body and the bored hole in the door (to protect the connection of the flexible circuit to the electronic module a cylindrical stop can be secured to the flexible circuit which is trapped by a reduced diameter shoulder in the bore through the cylinder body). The flexible circuit is connected to the power source (one or more batteries).

Figure 2:
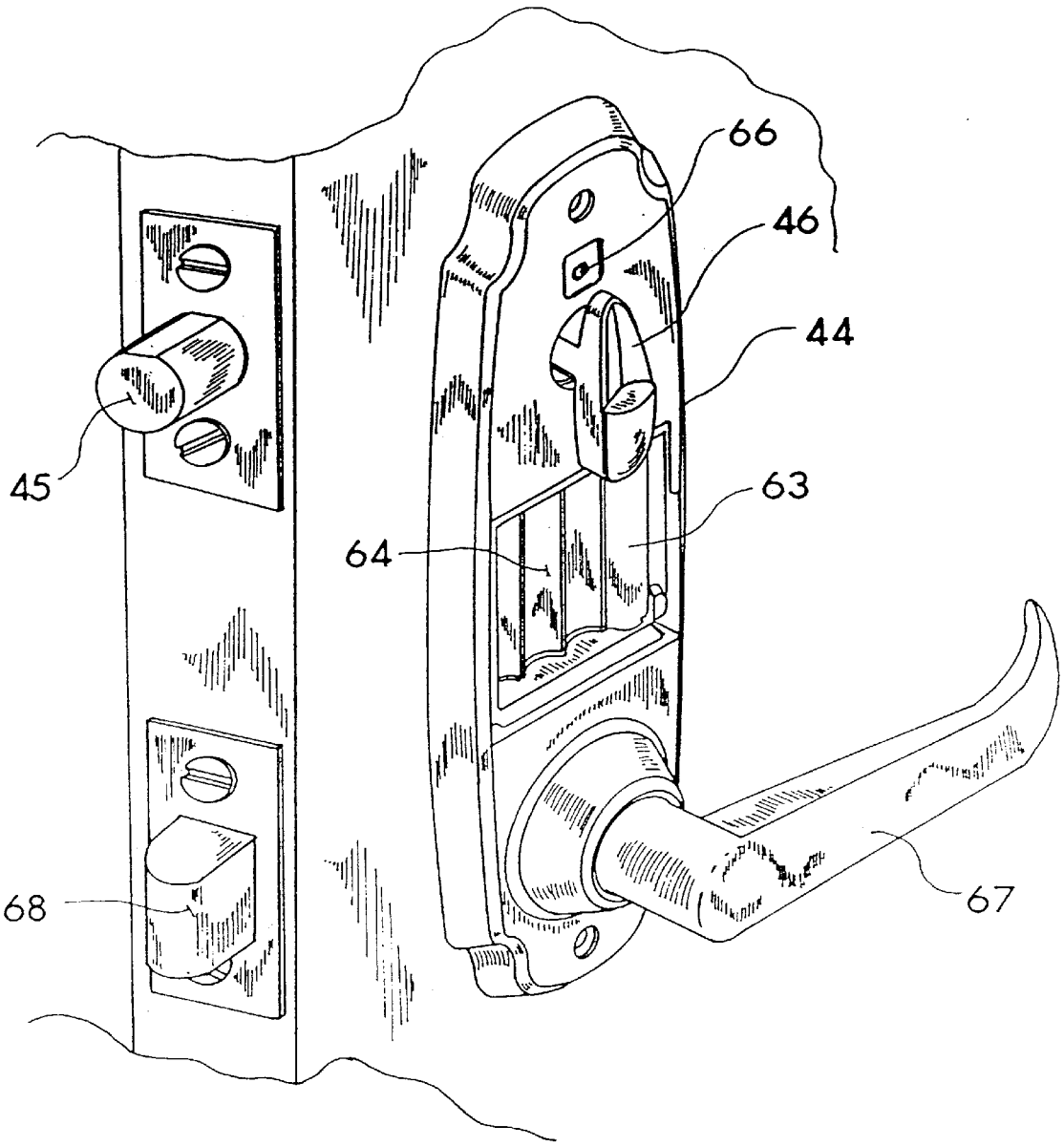
FIG. 2 is a side oblique view of the interior coverplate for the handleset in association with a door.
Figure 3:
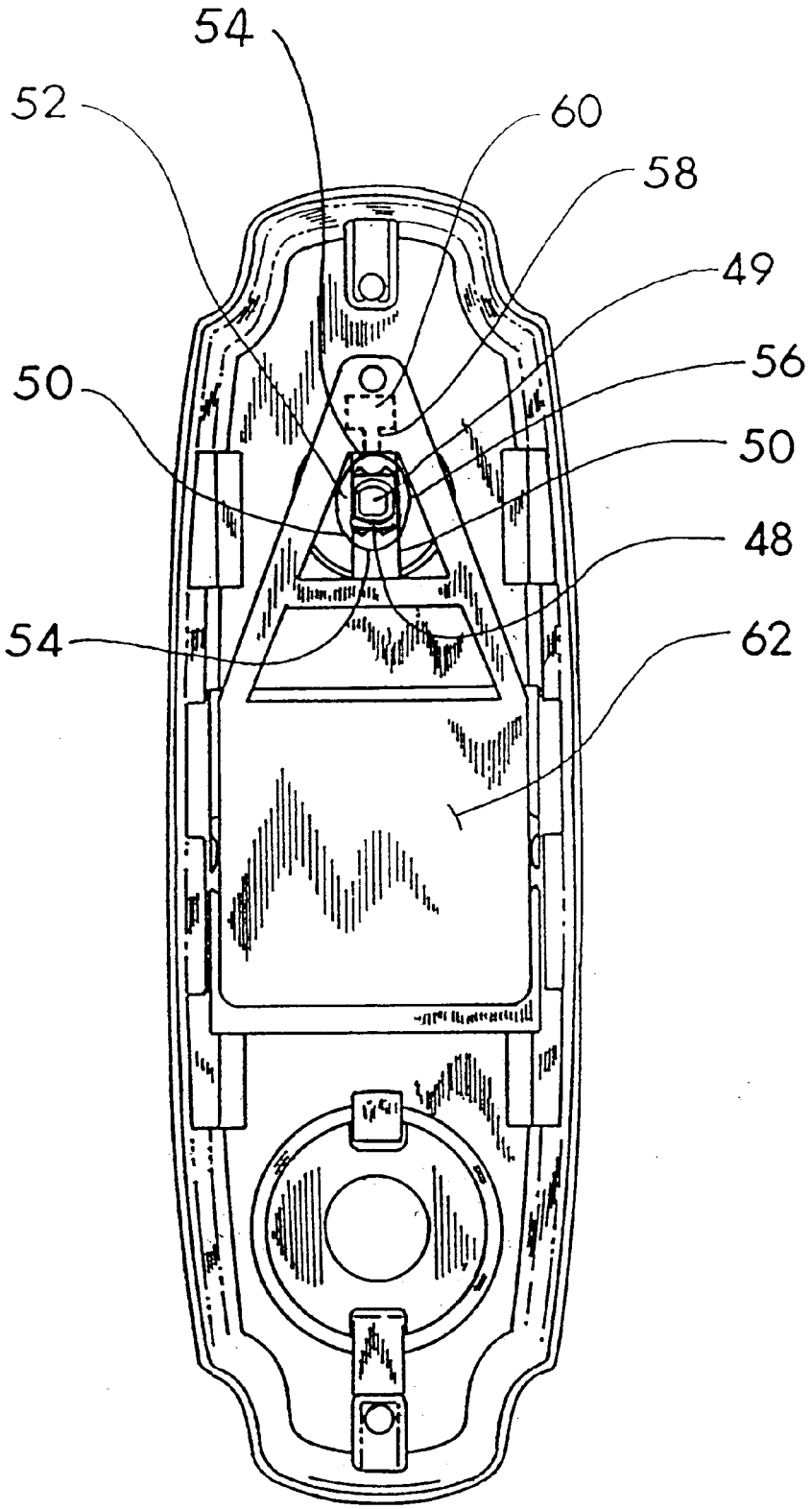
FIG. 3 is a rear view of the coverplate shown in FIG. 2.

The interior cover plate 44 is shown in FIG. 2. The upper deadbolt 45 is controlled from the inside by a turn lever 46 which can be turned front the illustrated vertical locked position to a horizontal unlocked position. As can be seen from FIG. 3, a square block 48, which is secured to the shaft 49 of the turn lever, is captured by a pair of parallel strip springs 50 so that the turn lever will be stable at either position. Also secured to the turn lever shaft is a cam 52 which has a pair of 180 degree related high spots 54 and a pair of 180 degree related low spots 56. When the turn lever is vertical a high spot will be at the top of the cam and when the turn lever is horizontal a low spot will be at the top of the cam. The actuator 58 of a switch 60 follows the cam and operates the switch, which is connected to the wiring harness, when the turn lever is vertical. The switch, which is mounted on a carrier 62 secured to the interior cover plate, is connect to the electronic module. Also mounted on the carrier is a support 64 for a plurality of batteries (one shown 63) which power the electronics. An access plate (not shown) closes the opening in the interior cover plate. Also connected to the wiring harness is an interior L.E.D. 66 which is mounted on the interior cover plate. The lockset also includes an interior operator 67 which operates the bolt 68 of a latch assembly.

Figure 4:
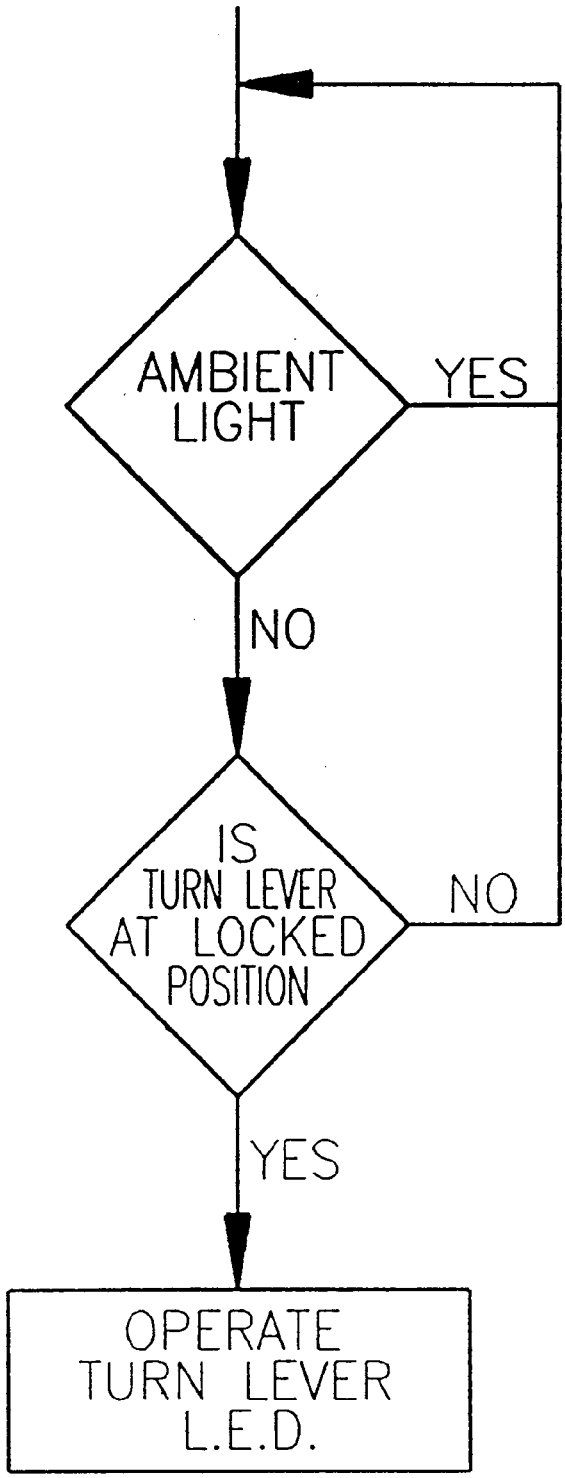
FIG. 4 is a logic diagram for the turn lever light control circuit of the handleset.

FIG. 4 illustrates the logic diagram for the turn lever L.E.D. 66 which is connected to the electronic module. The photo cell light sensor 21 associated with the deadbolt determines when it is dark outside. If this sensor determines that it is dark and if the turn lever is at a vertical position thereby operating the switch, the turn lever L.E.D. 66 will be illuminated. The color and intensity of this L.E.D. will be selected so that it can be seen in the dark to confirm that the door is locked. Alternatively, the turn lever L.E.D. can be illuminated during both daylight and nighttime whenever the turn lever is turned to the locked position.

Figure 5:
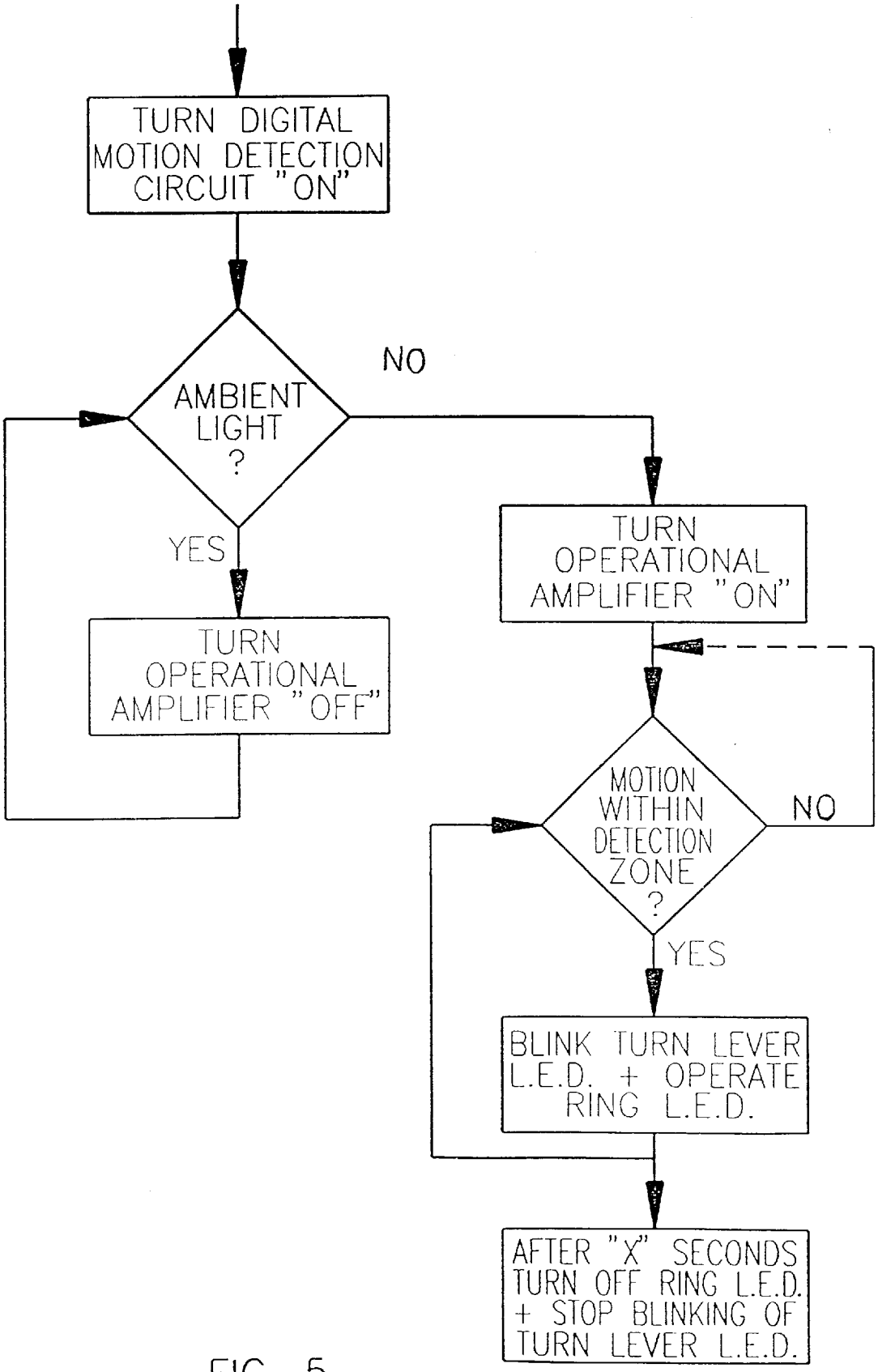
FIG. 5 is a logic diagram for the motion detection circuit of the handleset.

Referring to FIG. 5, the motion detection circuit has a lock operated digital portion for determining whether the light sensor sees ambient light and whether the motion detection sensor sees motion and an analog portion (an operational amplifier) which can supply energy to operate the L.E.D.s for a selected period of time (30 seconds, for example) while recharging during that time to operate the L.E.D.s, if required, for another 30 seconds.

The motion detection circuit can operate in either of two modes: a sleep mode where, while the digital circuit is "on," the operational amplifier (analog circuit) is "off " and a standby mode where both the digital circuit and the operational amplifier are "on."

When ambient light is sensed, the system will operate in the sleep mode (if operation in this mode is permitted) and when ambient light is not sensed, the system will operate in the standby mode. When the operational amplifier is "on" motion within the detection zone will operate both the ring and turn lever L.E.D.s. After they operate for a set period (30 seconds, for example), they turn off and if motion is still detected in the detection zone, they will again be operated, etc. Since the turn lever can be continuously on as a result of it being in the locked position the turn lever L.E.D. will blink when it is operated in response to motion being detected in the detection zone. Alternately, a separate L.E.D., which could have a unique color could be used to indicate such motion.

Both the analog circuit 70 and the digital circuit 72 are within the electronic module 19.

To minimize current use when an L.E.D. is on, a current minimizing circuit disclosed in U.S. patent application Ser. No. 08/554,070, filed Nov. 11, 1995, may be used.

We claim:

1. A lockset comprising:

a cylinder plug including a key receiving slot, a cover assembly for enclosing said cylinder plug, said cover assembly including a cover having a central opening and having first and second holes therein, a central translucent ring having a portion located within said central opening and having an outer annular surface, and an electronic module disposed beneath said cover assembly and selectively configured to matingly engage said outer annular surface of said translucent ring, said electronic module including light source means including an L.E.D. for radially directing light at the outer annular surface of said central translucent ring to illuminate said central translucent ring, a first sensor for sensing ambient light, said first sensor located in said first hole, a second sensor for sensing motion within a detection range, said second sensor located in said second hole, and an electronic circuit disposed within said electronic module and operable for illuminating said light source means when said first sensor senses ambient light below a predetermined level and said second sensor senses motion within the detection range, said electronic circuit including a first circuit responsive to an output of said first sensor and operable for switching said second sensor between a sleep mode when said ambient light is above said predetermined level and a standby mode when said ambient light is below said predetermined level, a second circuit responsive to an output of said second sensor generated when said second sensor is in said standby mode, and a third circuit responsive to said second circuit and operable for illuminating said L.E.D.

2. A lockset according to claim 1, further comprising battery means for powering said electronic module.

3. A lockset according to claim 2, further comprising a cylinder body for said cylinder plug, and said cylinder body including a front flange portion having a recess for receiving said electronic module.

4. A lockset according to claim 3, further comprising connection means for connecting said battery means to said electronic module, a cylinder housing for said cylinder body, and aligned holes in said cylinder housing and in said front flange portion of said cylinder body for receiving said connection means.

5. A lockset comprising a cylinder plug including a key receiving slot, a cover assembly for enclosing said cylinder plug including a cover having a central opening and a first hole and a second hole, a translucent ring having a portion located within said central opening between said cylinder plug and said cover, a cylinder body for receiving said cylinder plug, said cylinder body including a front flange, and a circuit module located between said front flange and said cover including a first sensor located in said first hole for sensing ambient light, a second sensor located in said second hole for sensing motion within a detection range, light source means located proximate said translucent ring to illuminate said ring, and said circuit module containing a first circuit responsive to an output of said first sensor and operable for switching said second sensor between a sleep mode when an ambient light condition is above a predetermined level and a standby mode when said ambient light condition is below said predetermined level, a second circuit responsive to an output of said second sensor generated when said second sensor is in said standby mode, and a third circuit responsive to said second circuit and operable for illuminating said light source means.

6. A lockset according to claim 5, wherein said translucent ring includes an annular surface defining the outer diameter of said ring and said circuit module has an inner surface for engaging with said annular ring surface, said circuit module supporting said light source means proximate said annular ring surface.

7. A lockset according to claim 6, wherein said circuit means is adapted to operate said light source means when said second sensor senses ambient light below a predetermined level and said first sensor senses motion within said detection range.

8. A lockset according to claim 7, wherein said front flange of said cylinder body includes a recess for receiving said circuit module.

9. The lockset according to claim 1 further including an interior cover plate and a portable power source contained within said interior cover plate for supplying electrical power to said electronic module.

10. The lockset of claim 5 further including an interior cover plate and a portable power source contained within said interior cover plate for supplying electrical power to said circuit module.

11. A self-contained illuminating lockset comprising:

a cylinder assembly including a cylinder body and a cylinder plug;

a cover having a central opening, a first hole and a second hole formed therein;

a translucent ring having a portion located within said central opening adjacent said cylinder plug and an outer annular surface;

an electronic module disposed beneath said cover and having an inner annular surface matingly engaging said outer annular surface of said translucent ring, said electronic module including:

an L.E.D. disposed along said inner annular surface and operable to radially direct light toward said outer annular surface of said translucent ring for providing illumination thereof;

a light sensor located in said first hole and operable to sense an ambient light condition;

a motion sensor located in said second hole and operable to sense motion within a detection range;

an activation circuit disposed within said electronic module and operably coupled to said first sensor and said second sensor for determining whether said ambient light condition is below a predetermined level and whether motion is detected within said detection range; and an illumination circuit disposed within said electronic module and operably coupled to said L.E.D. for illuminating said L.E.D. only when said ambient light condition is below said predetermined level and motion is detected within said detection range.

12. The lockset according to claim 11 wherein said activation circuit is operable in a sleep mode wherein said light sensor is operable while said motion sensor and said L.E.D are inoperable, and wherein said activation circuit is further operable in a standby mode wherein said light sensor, said motion sensor and said L.E.D. are operable.

13. The lockset according to claim 11 further including an interior cover plate and a portable power source contained within said interior cover plate for supplying electrical power to said electronic module.

* * * * *